US010610016B2

(12) United States Patent
Nilsson et al.

(10) Patent No.: US 10,610,016 B2
(45) Date of Patent: Apr. 7, 2020

(54) STORAGE SYSTEM, COVER STRIP, AND METHOD FOR PRODUCING A COVER STRIP

(71) Applicant: Elfa International AB, Västervik (SE)

(72) Inventors: Peter Nilsson, Västervik (SE); Fikret Arnautovic, Västervik (SE)

(73) Assignee: Elfa International AB, Vastervik (SE)

( * ) Notice: Subject to any disclaimer, the term of this patent is extended or adjusted under 35 U.S.C. 154(b) by 0 days.

(21) Appl. No.: 15/780,630

(22) PCT Filed: Nov. 30, 2016

(86) PCT No.: PCT/SE2016/051192
§ 371 (c)(1),
(2) Date: May 31, 2018

(87) PCT Pub. No.: WO2017/095312
PCT Pub. Date: Jun. 8, 2017

(65) Prior Publication Data

US 2018/0352953 A1 Dec. 13, 2018

(30) Foreign Application Priority Data

Dec. 1, 2015 (SE) ..... 1551570

(51) Int. Cl.
*A47B 96/14* (2006.01)
*A47B 57/16* (2006.01)
(Continued)

(52) U.S. Cl.
CPC ..... *A47B 96/1408* (2013.01); *A47B 57/16* (2013.01); *A47B 57/42* (2013.01); *A47B 95/04* (2013.01); *A47B 47/02* (2013.01)

(58) Field of Classification Search
CPC ..... A47B 96/1405; A47B 57/16; A47B 57/42; A47B 95/04
(Continued)

(56) References Cited

U.S. PATENT DOCUMENTS 2,261,956 A * 11/1941 Brownlie ..... A47B 57/40 108/185
3,342,095 A * 9/1967 Buntic ..... F16B 21/086 411/508
(Continued)

FOREIGN PATENT DOCUMENTS

DE 9409923 U1 12/1994
DE 10-2010-039533 A1 1/2012
(Continued)

OTHER PUBLICATIONS

International Search Report and Written Opinion received in Patent Cooperation Treaty Application No. PCT/SE2016/051192, dated Feb. 28, 2017, 14 pages.
(Continued)

*Primary Examiner* — Nkeisha Smith
(74) *Attorney, Agent, or Firm* — Hubbard Johnston, PLLC

(57) ABSTRACT

The present disclosure relates to a flexible cover strip for a storage system including a carrier rail (1) having a U-shaped cross section with first and second parallel rows (3, 5) of elongated substantially identical slots (7) in a front portion to accommodate a suspension element such as e.g. a bracket. The cover strip has an abutment face (17) and an exterior face (31), and a plurality of projections (19), rising from the abutment surface of the strip in first and second parallel rows matching the slots of the carrier rail, such that the cover strip can be fitted on the front portion with the projections entering the slots, and wherein at least some of the projections are provided with a snap element (27) at their distal
(Continued)

ends, which snap elements prevent the cover strip from falling off the rail.

11 Claims, 5 Drawing Sheets

(51) Int. Cl.
*A47B 57/42* (2006.01)
*A47B 95/04* (2006.01)
*A47B 47/02* (2006.01)

(58) Field of Classification Search
USPC ..... 248/243, 345.1, 235, 250
See application file for complete search history.

(56) References Cited

U.S. PATENT DOCUMENTS 3,532,212 A 10/1970 Gatton et al.
3,933,102 A * 1/1976 Brunette ..... A47F 5/10 108/107
4,453,641 A * 6/1984 Rasmussen ..... A47F 1/12 211/151
4,513,669 A * 4/1985 Steinke ..... A47B 57/48 108/107
4,515,494 A * 5/1985 Robilliard ..... A47B 57/402 403/187
5,004,201 A * 4/1991 Bessinger ..... A47B 57/42 108/108
5,199,585 A * 4/1993 Schafer ..... A47B 57/42 108/107
5,253,835 A 10/1993 Herron, III
5,370,249 A * 12/1994 Harvey ..... A47B 57/42 211/189
5,423,510 A * 6/1995 Almoslino ..... A47B 95/00 248/243
6,644,609 B1 * 11/2003 Scott ..... A47B 57/42 248/243
7,216,380 B2 * 5/2007 Vaskuthy ..... A47C 23/00 248/345.1
7,770,861 B2 * 8/2010 Huxtable ..... A47B 95/043 248/345.1
8,365,928 B1 * 2/2013 Lauro ..... A47B 57/34 108/108
8,561,953 B2 * 10/2013 Waggoner ..... A47B 96/1408 248/220.21
2005/0284586 A1 12/2005 Mullet et al.
2007/0089819 A1 * 4/2007 Zenkich ..... A47F 5/0043 150/158

FOREIGN PATENT DOCUMENTS

DE 102010039533 A1 1/2012
RU 126913 U1 4/2013

OTHER PUBLICATIONS

Partial Supplementary European Search Report received in European Application No. 16871154.7, dated Apr. 3, 2019, 10 pages.
Search Report received in Russian Application No. 2018119537, dated Dec. 16, 2019, 2 pages.

* cited by examiner

STORAGE SYSTEM, COVER STRIP, AND METHOD FOR PRODUCING A COVER STRIP

RELATED APPLICATION

This application, a national phase application of PCT/SE2016/051192, filed Nov. 30, 2016, which claims priority to Swedish Application No. 1551570-3 filed Dec. 1, 2015.

TECHNICAL FIELD

The present disclosure relates to a storage system including a carrier rail having a U-shaped cross section with a first and a second leg interconnected by a front portion, wherein the front portion is provided with first and second parallel rows of elongated slots to accommodate a suspension element such as a bracket, a basket or the like. The disclosure further relates to a cover strip and to a method for producing a cover strip.

BACKGROUND

Such a system is disclosed for instance in EP-1635670-A1, where in an example the carrier rail supports a set of hooks or a basket. The carrier rail as well as the devices attached thereto may be produced from sheet metal. One problem associated with systems of that kind is that attaching a device to the rail can be somewhat noisy.

SUMMARY

One object of the present disclosure is therefore to accomplish a system where such noise can be dampened to some extent thereby providing an improved consumer experience. This object is achieved by means of a storage system as defined in claim 1. More specifically, in a system of the initially mentioned kind, a flexible cover strip is provided having an abutment face and an exterior face. The cover strip includes a plurality of projections, elongated in the longitudinal direction of the strip, rising from the abutment face surface of the strip in first and second parallel rows, wherein the proximal end of each projection has a length that is equal to or shorter than the length of a carrier rail slot and a width that is narrower than or equal to the width of a slot, and wherein the projections are located on the cover strip in a pattern coinciding with slots on a front portion of the carrier rail. Thereby, the cover strip can be fitted on the front portion with the projections entering the slots, and at least some of the projections are provided with a snap element at their distal ends, which snap elements engage with the slots and prevent the cover strip from falling off the rail. A relatively softer cover strip of this type can help dampening sound propagating along the carrier rail such that noise is reduced to some extent. Additionally, as the front surface of the strip can be smooth, a visually attractive exterior is achieved that is easy e.g. to clean.

The snap element may be wider than the projection at the proximal end thereof, and may further include tips that project towards the abutment face. The distance between the end of such a tip and the abutment face may be smaller than the thickness of the rail at the front portion. This makes the cover strip pinch the carrier rail to some extent at the location of the slot which may improve the sound dampening effect.

Alternatively, or in combination therewith, the projections may rise obliquely from the abutment face. This may be used to allow the projections themselves to keep the strip in place.

A longitudinal tear line cut may be provided in the centre of the abutment face along the length of the cover strip. This facilitates removal of parts of the cover strip to expose slots in the carrier rail intended for use. Further, the projections may be provided in pairs, and transversal tear line cuts may be provided in the abutment surface between adjacent pairs of projections. This makes the above mentioned removal easier.

The exterior face of the cover strip may be convex, providing a curvature along the length of the cover strip.

A flexible cover strip is also considered having an abutment face and an exterior face, the cover strip including two parallel rows of projections, elongated in the longitudinal direction of the strip, rising from the abutment surface of the strip and being arranged in pairs, wherein the distal end of each projection comprises a snap element which is wider than the proximal end of the projection, wherein a longitudinal tear line is cut in the centre of the abutment face along the length of the cover strip in between the projections in each pair, and wherein transversal tear lines are cut in the abutment surface between adjacent pairs of projections.

Further, a method for producing a flexible cover strip in an elastomer material, is considered, which method involves extruding a strip comprising first and second ridges extending from a flat surface along the length of the strip; and cutting the ridges transversally and down to the flat surface with respect to the length of the strip to provide pairs of projections with intervening spaces. This allows cover strips of arbitrary length to be produced at a reasonable cost.

The extruding may then create a longitudinal tear line cut in the centre of the flat surface and the cutting may include cutting transversal tear lines in the surface between adjacent pairs of projections.

DETAILED DESCRIPTION

Figure 1:
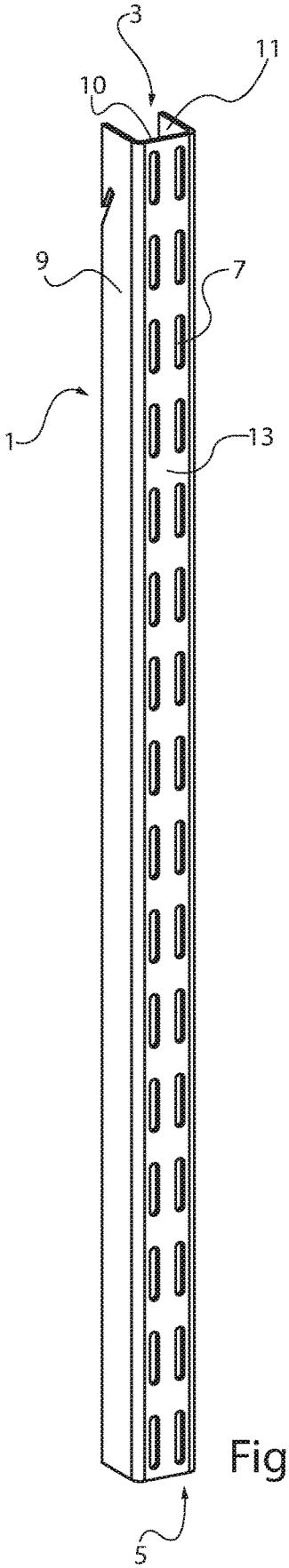
FIG. 1 shows a perspective view of a carrier rail.

The present disclosure relates to a storage system comprising a carrier rail 1 as illustrated in FIG. 1. The carrier rail/element 1 may be made up by a single elongated piece of sheet metal in which a first 3 and a second 5 row of elongated slots 7 are punched. The carrier rail may then be formed by bending the elongated piece along its length to form a carrier rail 1 with U-shaped cross section as shown in FIG. 1. The carrier rail thus has, in cross section, a first leg 9 and a second leg 11, as well as a front piece 10 or web presenting a front surface 13 and interconnecting the first 9 and second 11 legs, as indicated in FIG. 1. Such carrier rails 1 are well known per se, see for instance EP-1635670-A1, and may be attached to a wall or other vertical surface e.g. using screws, with the leg portions 9, 11 of the rail abutting the wall, or may be attached to sets of feet that stand on a floor. In general, the carrier rail 1 is arranged vertically. Shelves, baskets, brackets and the like may be attached to the rail by inserting hooks into selected slots 7 in the rail, as is well known per se. For instance, two carrier rails may be used and a bracket may be attached to each rail. A shelf may rest on the brackets, such that a storage surface is accomplished as is well known per se.

Figure 2:
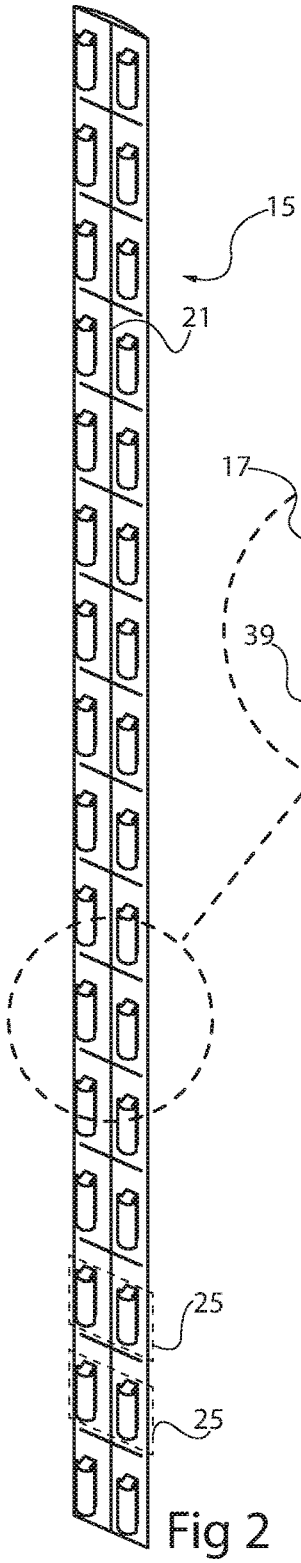
FIG. 2 shows a perspective view of a cover strip suitable for the carrier rail in FIG. 1.
Figure 3:
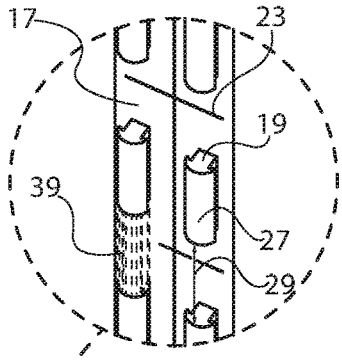
FIG. 3 shows an enlarged portion of the cover strip in FIG. 2.

FIG. 2 shows a cover strip 15 according to an example of the present disclosure. The cover strip 15 may be produced in one piece in an elastomer material such as for instance PPE (Polyphenylene Ether), PP-R (Polypropylene Random), or a soft PVC (Polyvinyl Chloride). In general, as shown in the enlarged portion of FIG. 3, the cover strip has an abutment face 17, that is intended to abut the front surface 13 of the carrier rail 1. A number of projections 19 are provided extending from the abutment face 17. As shown in FIG. 2 the projections 19 are arranged in pairs in two rows with a configuration that matches the slot 7 configuration in the carrier rail front surface, such that the projections can be inserted into the slots as will be shown. However, it would be possible to leave out some projections in the configuration, such that not all slots of the carrier rail 1 have a corresponding projection. As shown in FIG. 2, the carrier strip has a longitudinal tear line 21, that extends along the length of the cover strip. The tear line comprises a cut in the lateral centre of the abutment face 17 surface. Similarly, as most clearly illustrated in FIG. 3, the carrier strip comprises transversal tear lines 23 that are disposed in between each consecutive pair 25 of projections 19. The longitudinal tear line 21 and the transversal tear lines 23 facilitate removing some of the projections 19 together with the cover strip area surrounding each removed projection, such that some of the slots of the carrier rail 1 may be exposed even though the cover strip is fitted on the carrier rail. As most clearly shown in FIG. 3, each projection 19 may comprise a snap element 27 at the distal end of the projection, i.e. the part of the projection 19 that is located most distant from the abutment surface 17. In general, each projection 19 is elongated along the abutment face in the longitudinal direction of the cover strip as a whole, and may have a length that is similar to, or slightly shorter than the length of a slot 7, and a width that is narrower than or equal to the width of the slot, such that the projection can fit therein. However, at the distal end of the projection, the snap element 27 may be wider than the slot 7. As shown for instance in FIG. 3, a gap 29 is provided between each pair 25 of projections 19.

Figure 4:
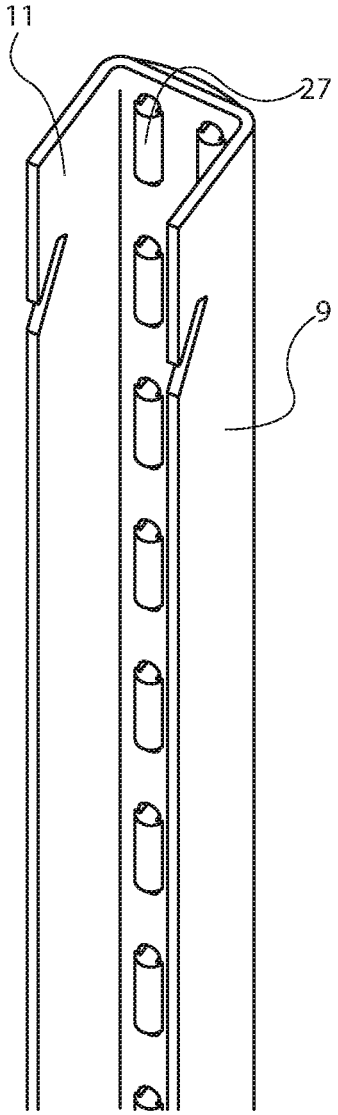
FIG. 4 shows a perspective view as seen from behind a front surface of the carrier rail when a cover strip is attached to the carrier rail.

FIG. 4 shows a perspective view as seen from behind the front surface 13 of a carrier rail 1, when the cover strip 15 has been fitted thereto. As can be seen, projections extend into each slot and the snap elements 27 have resiliently expanded once pressed through the slots, such that the cover strip is kept in place. When fitted in this way, the cover strip 15 provides a sound dampening function which means that for instance when a bracket is attached to some of the slots, which implies that two sheet metal parts are assembled, the resulting noise is dampened to some extent by the cover strip. In addition to this effect, the cover strip 15 may provide a uniform outer surface without unnecessary openings, and can easily be cleaned as is clear, for instance, from FIG. 6.

Figure 5:
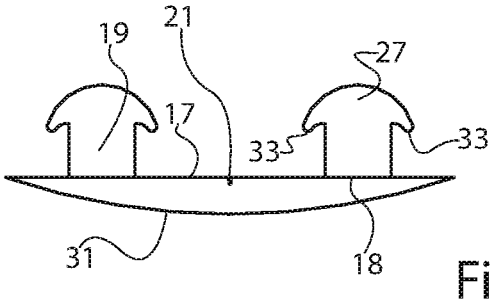
FIG. 5 shows a side view of a cover strip.

FIG. 5 shows a side view of the cover strip. A shown, the exterior face 31 of the cover strip 15 may be somewhat convex, and the abutment face 17 may be substantially flat, except where the projections 19 rise from the abutment face 17. As shown in FIG. 5, the snap element 27 at the distal end of the projection 19 may comprise first and second tips 33 that extend to some extent towards the abutment face 17. This means that if the cover strip 15 is attached to a carrier rail where the thickness of the carrier rail sheet metal is thicker than the distance between the tips 33 and the abutment face 17, the sheet metal of the carrier rail front surface 13 will to some extent be pinched between the tips 33 and the abutment face 17, further reducing the transmission of any sound. Other examples are however conceivable where the snap element simply is wider than the projection 19 at the proximal end 18 thereof.

As shown, the longitudinal tear line extends through less than half of the thickness of the cover strip 15, although it can be deeper, but still facilitates the removal of some parts of the cover strip. This removal may be carried out by cutting with a pair of scissors or a sharp knife, or simply by tearing off the desired portions if the tear line cut is deep enough. The cover strip, as will be discussed later, may be produced by extruding an elastic polymer strip having a uniform cross section as shown by the side view in FIG. 5.

Figure 6:
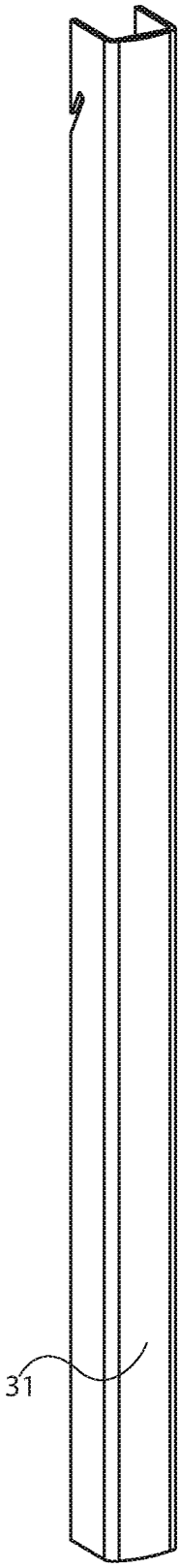
FIG. 6 shows a carrier rail when a cover strip has been attached thereto and no attachment slots have been exposed.

FIG. 6 shows a case where a cover strip 15 with no removed parts is fitted on a carrier rail 1.

Figure 7:
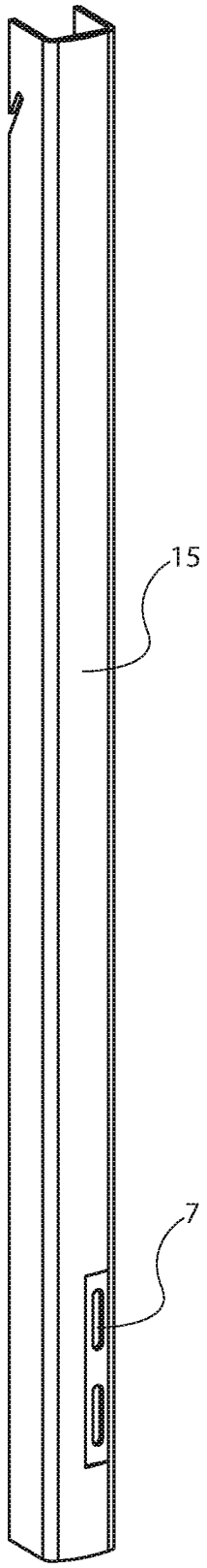
FIG. 7 shows a view similar to FIG. 6 where two consecutive slots in a row have been exposed.
Figure 8:
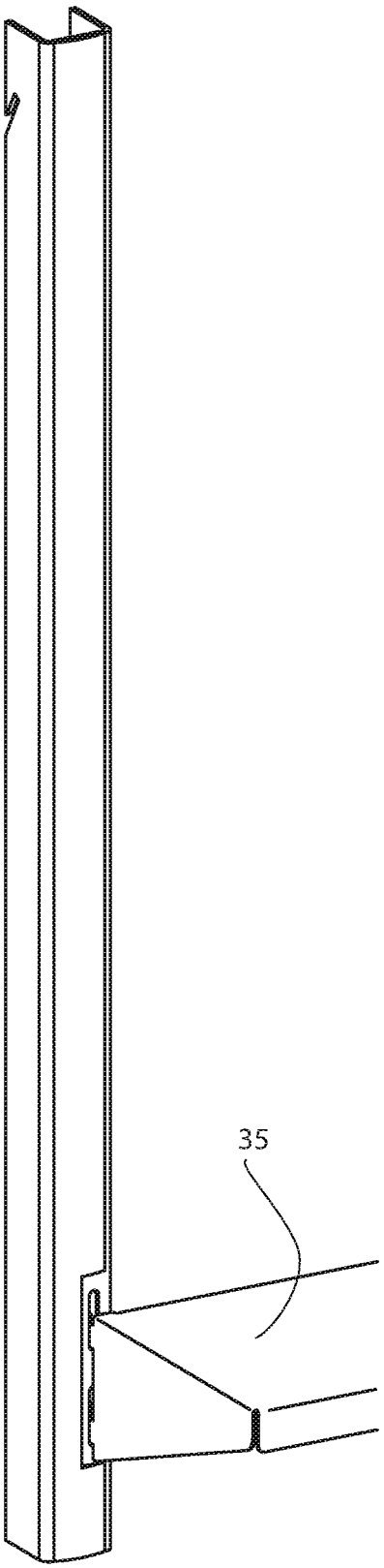
FIG. 8 shows the carrier rail in FIG. 7 where a shelf has been attached using the two exposed slots.

FIG. 7 shows a case where two adjacent projections in a row have been removed, by cutting the cover strip 15 along corresponding tear lines, together with the surrounding areas, to expose the corresponding slots. One half of each of two transversal tear lines are cut and the longitudinal tear line is cut in between these two transversal lines. This enables the attachment of a sheet metal shelf 35 using the two exposed slots 7 in the carrier rail, as illustrated in FIG. 8.

Figure 9:
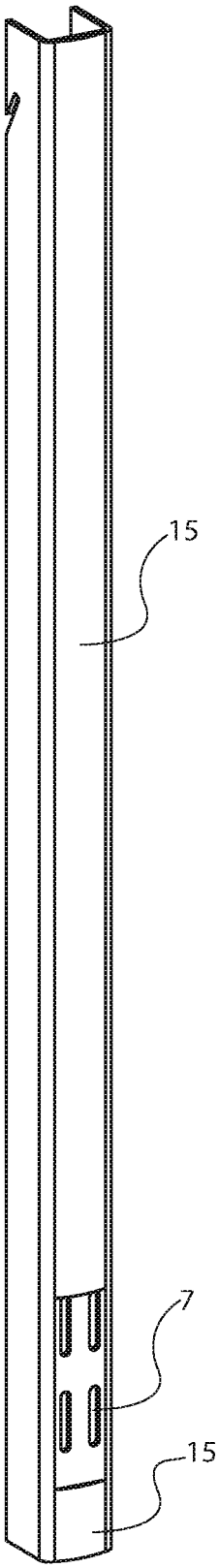
FIG. 9 shows an example where two consecutive pairs of slots have been exposed.
Figure 10:
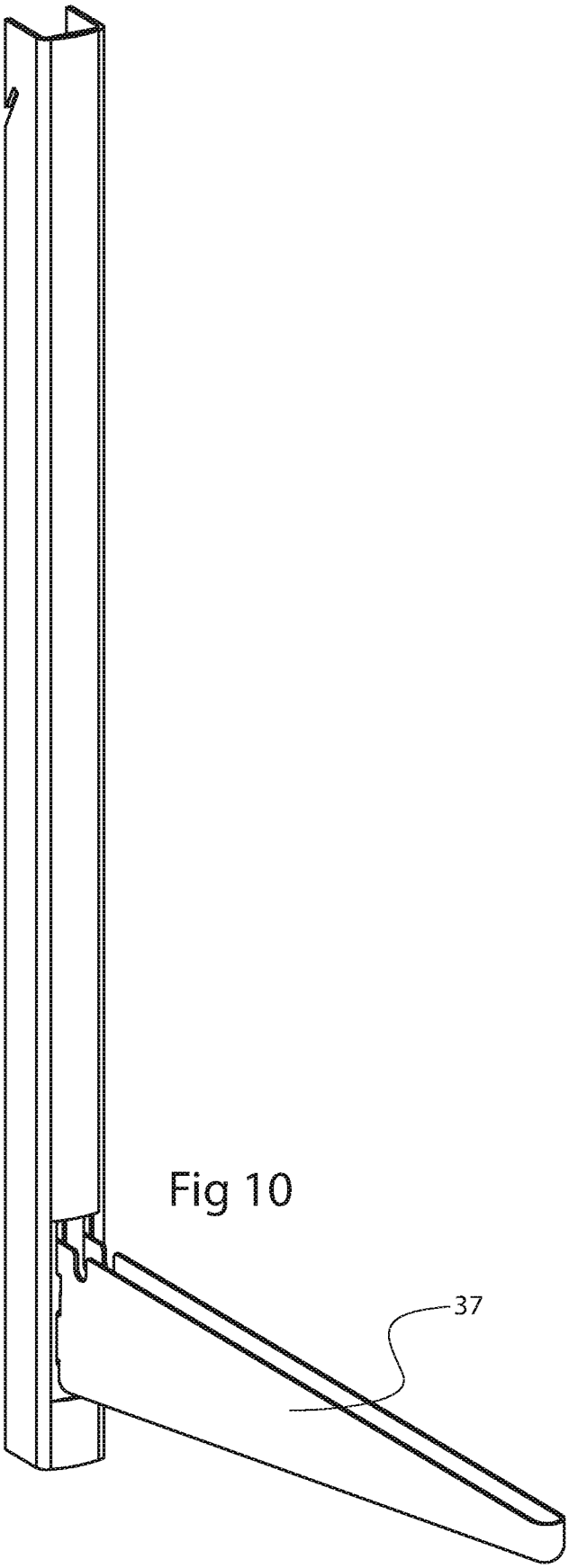
FIG. 10 shows the carrier rail in FIG. 9 where a bracket has been attached to the carrier rail using the four exposed slots.

FIG. 9 shows another example where two adjacent pairs of slots have been exposed by cutting the cover strip 15 along the transversal tear line at two locations. This allows a bracket 37 to be attached using all four exposed slots 7 as illustrated in FIG. 10.

Figure 11:
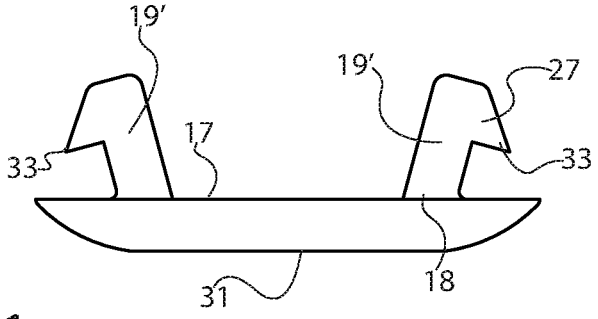
FIG. 11 shows a side view of an alternative cover strip.
Figure 12:
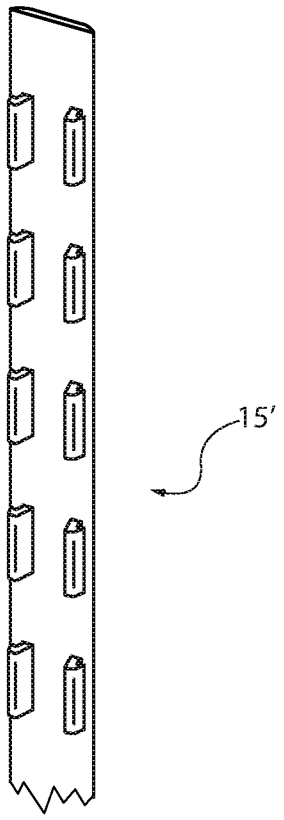
FIG. 12 shows a perspective view of the cover strip of FIG. 11.

FIG. 11 shows a side view of an alternative cover strip 15', which is also shown in a perspective view in FIG. 12. In this strip 15', the projections 19' rise obliquely from the abutment surface 17. At their proximal ends 18, the projections may have the same configuration as shown in FIG. 5, coinciding with slots 7 of a carrier rail, but rise in a direction inclined away from the midpoint of the strip 15'. At the same, the distal ends as shown can be formed such that the projections 19' flex inwards when pressed towards the carrier rail. When each snap element 27 has entered far enough into a slot, the projection 19' will snap back out. When attached, the projections 19' can be slightly urged towards the side of its respective slot. This helps to centre the strip on the rail. Also, the projections themselves help keeping the strip locked in place. Tips 33 may nevertheless be provided on the snap elements.

It would be possible to produce cover strips according to above-described example by injection moulding, but strips longer than approximately 40 cm would imply relatively expensive injection moulding tools. Therefore, an alternative production method has been considered where a cover strip which is uniform along its length and has a cross section as indicated by the profile in FIG. 5 is extruded in a first step. In a second step, ridges that will form the projections are cut transversely with regard to the elongated direction of the rail to remove e.g. the material 39 indicated by dashed lines in FIG. 3. The optional longitudinal tear line may be provided in the extruding step while transversal tear lines may be cut in the second or a later step. In this way, the strip can be produced in an arbitrary length.

The present disclosure is not restricted to the examples given above, and may be varied and altered in different ways within the scope of the appended claims.

The invention claimed is:

1. A storage system including a carrier rail having a U-shaped cross section with a first and a second leg interconnected by a front portion, wherein the front portion is provided with first and second parallel rows of elongated slots to accommodate a suspension element, the system comprising:

a flexible cover strip having a flat abutment face and an exterior face, the flexible cover strip including a plurality of projections, elongate in the longitudinal direction of the strip, rising from the abutment face of the strip in first and second parallel rows, wherein the projections rise obliquely from the abutment face, wherein a proximal end of each projection has a length that is equal to or shorter than a length of a slot and a width that is narrower than or equal to the width of a slot, wherein the projections are located on the cover strip in a pattern coinciding with slots on a front surface of the rail, such that the cover strip can be fitted on the front portion with the projections entering the slots, and wherein at least some of the projections are provided with a snap element at their distal ends, which snap elements prevent the cover strip from falling off the rail.

2. A storage system according to claim 1, wherein the snap element is wider than the projection at the proximal end thereof.

3. A storage system according to claim 2, wherein the snap element includes tips that project towards the abutment face and wherein a distance between an end of a tip and the abutment face is smaller than a thickness of the rail at the front portion.

4. A storage system according to 2, further comprising a longitudinal tear line cut in the abutment face along the length of the cover strip.

5. A storage system according to claim 2, wherein the projections are provided in pairs, and wherein transversal tear lines are cut in the abutment surface between adjacent pairs of projections.

6. A storage system according to claim 2, wherein the exterior face of the cover strip is convex, providing a curvature along the length of the cover strip.

7. A storage system according to claim 2, wherein the cover strip is produced in a single piece in an elastomer material.

8. A storage system according to claim 1, further comprising a longitudinal tear line cut on the abutment face along the length of the cover strip.

9. A storage system according to claim 1, wherein the projections are provided in pairs, and wherein transversal tear lines are cut in the abutment surface between adjacent pairs of projections.

10. A storage system according to claim 1, wherein the exterior face of the cover strip is convex, providing a curvature along the length of the cover strip.

11. A storage system according to claim 1, wherein the cover strip is produced in a single piece in an elastomer material.

* * * * *